United States Patent [19]

Brilando

[11] Patent Number: 4,712,789

[45] Date of Patent: Dec. 15, 1987

[54] CYCLE EXERCISERS

[75] Inventor: Frank P. Brilando, Niles, Ill.

[73] Assignee: Schwinn Bicycle Company, Chicago, Ill.

[21] Appl. No.: 36,882

[22] Filed: Apr. 10, 1987

[51] Int. Cl.[4] ..... A63B 21/00; F16H 37/06; F16H 7/00

[52] U.S. Cl. ..... 272/73; 74/665 GE; 474/86

[58] Field of Search ..... 272/73, 71, 72; 280/224, 233; 74/665 GE; 474/86, 87, 88, 89; 128/25 R

[56] References Cited

U.S. PATENT DOCUMENTS

| | | | |
|---|---|---|---|
| 326,247 | 9/1885 | Root . | |
| 998,365 | 7/1911 | MacLean | 474/88 |
| 2,032,303 | 2/1936 | Orgitano | 128/25 |
| 2,261,355 | 11/1941 | Flynn | 128/25 |
| 2,320,489 | 6/1943 | Turner et al. | 272/73 |
| 2,453,771 | 11/1948 | White et al. | 128/25 |
| 2,565,348 | 8/1951 | Brockman et al. | 128/25 |
| 2,872,191 | 2/1959 | Gallo, Sr. | 272/73 |
| 3,112,108 | 11/1963 | Hanke | 272/58 |
| 3,578,800 | 5/1971 | DeNepi | 272/73 |
| 3,758,111 | 9/1973 | Agamian | 272/73 |
| 3,940,128 | 2/1976 | Ragone | 272/73 |
| 3,979,113 | 9/1976 | Uhl et al. | 272/73 |
| 4,188,030 | 2/1980 | Hooper | 272/73 |

FOREIGN PATENT DOCUMENTS

| | | | |
|---|---|---|---|
| 132504 | 5/1949 | Australia | 272/73 |
| 7700 | 12/1893 | France | 280/233 |
| 89009 | 4/1967 | France | 272/73 |
| 89347 | 6/1967 | France | 272/73 |
| 2003598 | 11/1969 | France | 272/73 |
| 2500311 | 8/1982 | France | 272/73 |
| 453982 | 8/1968 | Switzerland | 272/73 |

OTHER PUBLICATIONS

Schwinn, "Air-Dyne", brochure published by Excelsior Fitness Equipment Co., Northbrook, Ill.

Schwinn, "Air-Dyne" brochure, Copyright 1986.

*Primary Examiner*—Richard J. Apley

*Assistant Examiner*—S. R. Crow

*Attorney, Agent, or Firm*—McCaleb, Lucas & Brugman

[57] ABSTRACT

A cycle exerciser having a wheel rotatably mounted on a frame and arranged to absorb energy applied to the wheel through a pair of foot pedals and/or a pair of handlebar levers. A pedal-driven main drive shaft is connected to a countershaft through a first speed-increasing chain and sprocket mechanism, and the countershaft is connected through a second speed-increasing chain and sprocket mechanism to the energy-absorbing wheel. The main drive shaft is connected through a one-to-one chain and sprocket mechanism to another countershaft enabling the main drive shaft and the other countershaft to rotate at the same speed. The handlebar levers are connected to a pair of drive crank arms which are secured to opposite end portions of the other countershaft.

14 Claims, 6 Drawing Figures

CYCLE EXERCISERS

BACKGROUND OF THE INVENTION

This invention relates to cycle exercisers and particularly to an ergometer-exerciser which works muscle groups in the arms, legs, and upper and lower torso, thereby placing a uniformly high demand on the blood and oxygen circulation systems throughout the entire body.

Ordinary cycle exercisers are in the nature of a stationary, one-wheel cycle, with a pedal-driven apparatus applying work to a resistance wheel of some kind. They have the disadvantage of exercising only the muscles of the legs and lower torso.

Running and jogging are of greater benefit because more muscle groups are used, thereby placing a greater, more uniform demand on the body's blood and oxygen systems.

However, running has disadvantages, too. Mostly, this is an outdoor activity which is practiced on public streets, roads, and sidewalks. Vehicle traffic is an ever present danger. Bad weather makes it disagreeable. There is no way of measuring the work expended. Heart beat monitors are used by some joggers but there is little if any relationship between the readings and muscle work output. Special foot-wear is required to prevent foot and leg injuries. And many people, do to excess weight, arthritis, bad feet or legs, or other ailment, simply cannot run.

On the other hand, a stationary cycle-type exerciser which exercises the whole body through the arms and legs is a great improvement over running and jogging. It can be used indoors, it is safe from traffic hazards, and entirely independent of bad weather. Work input is precisely measureable. Foot and leg injuries are no problem. And most people regardless of weight, size, or physical problems, can use one.

One example of such a cycle exerciser which effectively works muscles in the arms, legs, and upper and lower torso simultaneously, is disclosed in Hooper U.S. Pat. No. 4,188,030 issued Feb. 12, 1980.

SUMMARY OF THE INVENTION

Accordingly it is a general object of the present invention to provide an improved, cycle-type ergometer-exerciser capable of simultaneously working muscle groups in the arms, legs and upper and lower torso while precisely measuring the work output.

According to the present invention, there is provided a cycle exerciser including a frame, a seat mounted on the frame, energy absorbing means rotatably mounted on the frame, a substantially horizontal main drive shaft rotatably carried by the frame, foot pedal crank arms at opposite ends of the main drive shaft, a pair of countershafts rotatably carried by the frame, two handlebar levers mounted on the frame for oscillating movement, first drive means including means connecting the main drive shaft to the energy absorbing means through one of the countershafts to cause rotation of the energy absorbing means in response to rotation of the main drive shaft, a pair of drive crank arms secured to opposite end portions of the other countershaft and extending laterally therefrom in opposite directions, and second drive means including means connecting each of the handlebar levers to a respective one of the drive crank arms and means connecting the other countershaft to the main drive shaft to cause rotation of the main drive shaft in response to oscillating movement of the handlebar levers.

More particularly, the countershafts are coaxial, one being a hollow tube and the other being concentrically rotatable therewithin. The first drive means comprises separate, orbitally moveable, endless driving means such as a chain or belt trained between the main drive shaft and the energy absorbing means via said one countershaft. The main drive shaft and said other countershaft rotate at the same speed. The second drive means includes a drive bar pivotally connected between each handlebar lever and a corresponding one of the drive crank arms, and a chain and sprocket connection between the other countershaft and the main drive shaft.

More particularly, in the embodiment illustrated, the first drive means for causing rotation of the energy absorbing means comprises: a first sprocket on the main drive shaft and a second, smaller sprocket on one of the countershafts; a third sprocket on said one countershaft and a fourth sprocket smaller than the third sprocket, in driving relation with the energy absorbing means; chain means interconnecting the first and third sprockets and the third and fourth sprockets respectively; and means interconnecting said other countershaft and said main drive shaft comprising a chain connecting fifth and sixth, same-size sprockets mounted on said other countershaft and said main drive shaft respectively.

Among other specific features of the invention, the above-menioned six sprockets may be mounted on opposite sides of the frame in various positions on the main drive shaft and the two countershafts as will be described in detail.

BRIEF DESCRIPTION OF THE DRAWINGS

Other objects and advantages will be apparent from the following description taken in connection with the accompanying drawings in which.

Like parts are referred to by like reference characters.

DESCRIPTION OF THE PREFERRED EMBODIMENTS

Figure 1:
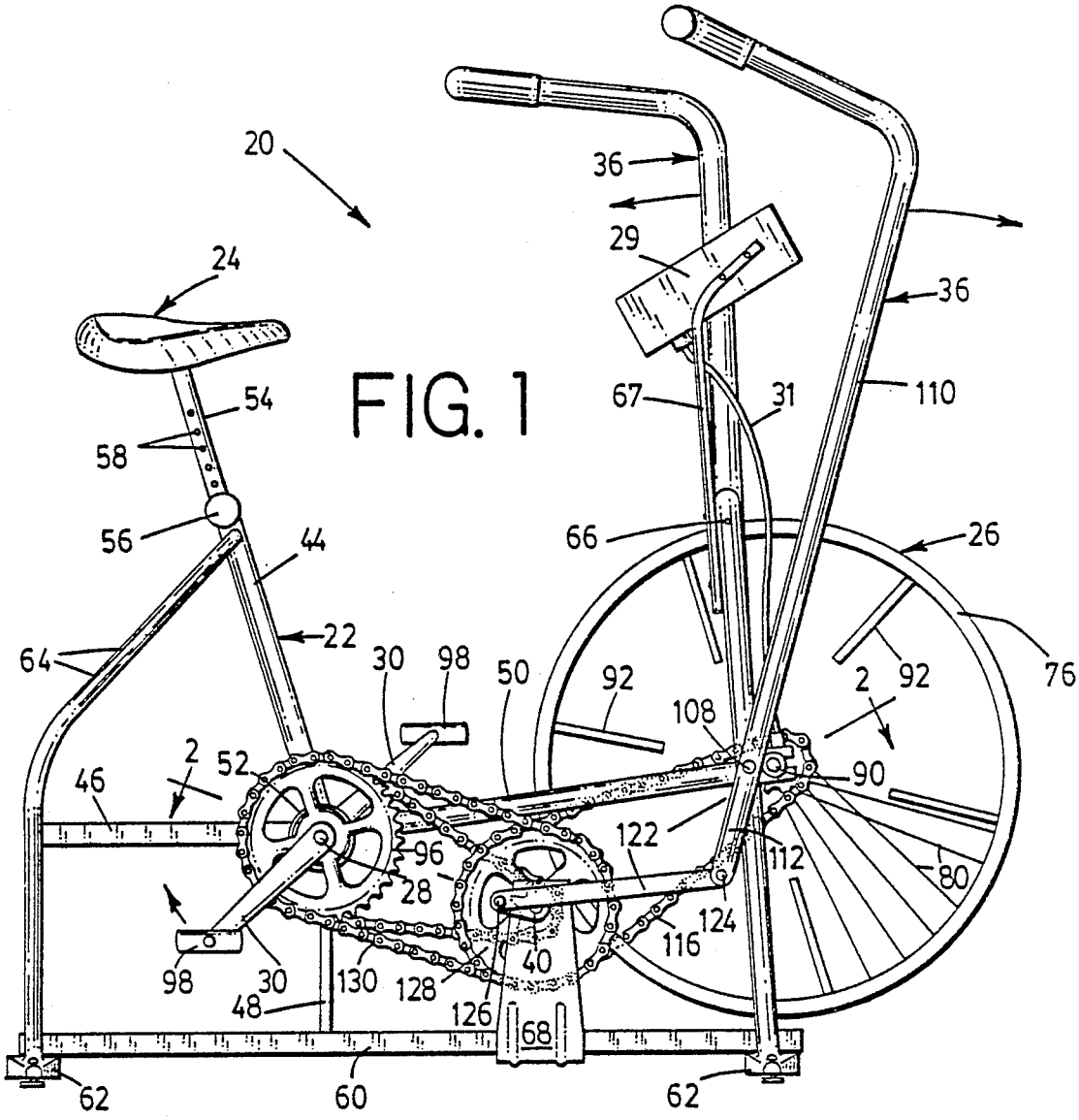
FIG. 1 is a right side elevational view of a cycle exerciser illustrating the present invention.
Figure 2:
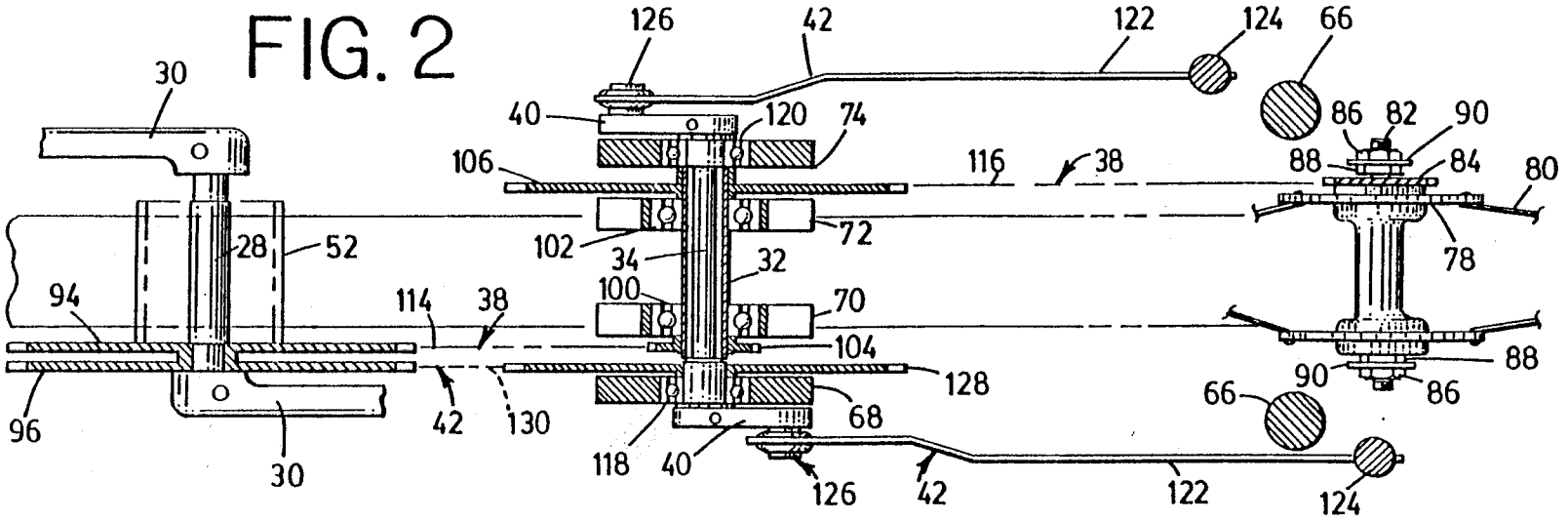
FIG. 2 is a fragmentary sectional view of FIG. 1 taken along line 2—2.

Referring now to the specific embodiments of the invention shown in the drawings, the cycle exerciser shown in FIGS. 1 and 2 is generally designated 20. It has a frame 22; a seat 24 mounted on the frame; energy-absorbing means 26 rotatably mounted on the frame; a horizontal main drive shaft 28 rotatably carried by the frame; foot pedal crank arms 30,30 at opposite ends of the main drive shaft; a pair of countershafts 32,34 rotatably carried by the frame; two handlebar levers 36,36 mounted on the frame for oscillating movement; first drive means 38 comprising means connecting the main drive shaft 28 to the energy-absorbing means 26 through one countershaft 32 to cause rotation of the energy-absorbing means in response to rotation of the main drive shaft; a pair of drive crank arms 40,40 secured to end portions of the other countershaft 34 and extending laterally therefrom in opposite directions; and second drive means 42 including means connecting each of the handlebar levers 36,36 to a respective one of the drive crank arms 40,40, and means connecting the other countershaft 34 to the main drive shaft 28 to rotate the later in response to oscillating movement of the handlebar levers. A workload indicator 29 is connected to the energy-absorbing means 26 through a cable 31.

The frame 22 comprises a seat tube 44; a rear bracket 46; a downward strut 48; and a horizontal fork 50, all secured to and extending radially outwardly from a crank shaft journal or bottom bracket 52. A saddle post 54 is telescopically slideably fitted in the seat tube 44 and the seat 24 is held at a selected height by engagement of an adjustment knob 56 with a selected one of openings 58 in the seat post. There is a longitudinally extending channel-type base member 60 with adjustable foot members 62,62. A pair of rearwardly and downwardly extending seat stays 64,64 are secured to the seat tube 44, rear bracket 46, and rear end of the base member 60. At its forward end, the frame 22 has an arched yoke 66 formed of tubing with its mid portions secured to the forward ends of the horizontal fork 50, and its lower ends secured to the front end of the base member 60. The workload indicator 29 is supported on the hoke 66 by a pair of upstanding curved rods 67. Four upstanding gudgeon plates 68, 70, 72, and 74 (FIG. 2) are carried by the base member 60.

The energy-absorbing means 26 is here illustrated schematically as a wheel having a rim 76 connected to hub 78 by spokes 80. The wheel is rotatably journaled about a stationary axle 82 which is supported at the front end of the frame. A chain sprocket 84 is fastened to the hub 78 for rotation with the wheel. Retaining nuts 86 and lock nuts 88 grip a pair of stationary support struts 90 which are suitably fastened to the frame. Resistance to wheel rotation in the present case is achieved through air scoops or blades 92 secured within the rim of the wheel. Other means such as friction brake pads engageable with the wheel rim may be used.

The main drive shaft 28 may be rotatably journaled by conventional bicycle-type bearings (not shown) within the bottom bracket 52. A pair of chain sprockets 94,96 are fastened to the main drive shaft 28 for rotation therewith. The foot pedal crank arms 30,30 are fastened in any suitable manner to the ends of the shaft and bicycle-type pedals 98 are pivotally mounted to their outer ends.

The countershaft 32 is tubular and is rotatably journaled in bearings 100,102 carried by the two inner gudgeon plates 70,72 respectively. In the embodiment shown in FIGS. 1 and 2, a small chain sprocket 104 and a large chain sprocket 106 are fastened to opposite ends of countershaft 32 for rotation therewith.

Each handlebar lever 36,36 is pivotally connected to the frame about a pivot axis at 108. Each handlebar is generally upright and is pivoted so there is a relatively long portion 110 above the axis and a relatively short portion 112 below it. Referring now to the first drive means 38 which connect the main drive shaft 28 to the energy-absorbing wheel 26 through the one countershaft 32, this means includes a primary endless chain 114 connected between sprockets 94 and 104, and a secondary endless chain 116 connected between sprockets 106 and 84. In the present case, sprockets 94 and 106 are larger than sprockets 104 and 84, thereby causing the wheel 26 to rotate at a substantially higher speed than the main drive shaft 28.

It will be understood that instead of the chains and sprockets specifically illustrated, other endless, orbitally moveable, flexible drive means may be used, for example, V-, flat- or notched-belting with appropriate pulleys substituted for the sprockets.

The drive crank arms 40,40 extend in opposite lateral directions from the ends of the other countershaft 34. This is coaxial within countershaft 32 and is concentrically mounted therein and journaled for rotation by bearings 118,120 within gudgeon plates 68,74 respectively.

The second drive means 42 enables the handlebar levers 36,36 to rotate the main drive shaft 28. This second drive means includes a pair of drive links or bars 122 with the pivotal connections at 124,126 to corresponding ends of drive crank arms 40 and handlebar levers 36. This second drive means also includes a sprocket 128 which is connected by a chain 130 to sprocket 96 on the main drive shaft 28.

It is preferred for most efficient upper and lower body exercising that the pedal crank arms 30,30 and handlebar levers 36,36 cycle at the same frequency. For this purpose sprockets 96, 128 should be the same size so the main drive shaft 28 and other countershaft 34 will rotate at the same speed. The relative angular positions of the sprockets 96 and 128 may be set to coordinate pedal and handlebar movements in any preferred way. For example, the handlebar levers may be moved with, or opposite to, pedal movement, as desired.

For manufacturing economy and parts-stocking convenience, sprockets 94, 96, 106, and 128 may all be the same, large size and sprockets 84,104 may be the same, small size. As one specific example, the large sprockets may be about 3.8 times larger than the small sprockets. This enables the wheel 26 to rotate approximately 14.5 times as fast as the main drive shaft 28.

Use and operation are believed obvious in view of the above description. Briefly, in the embodiment illustrated, with the sprocket ratios shown, one rotation of the main drive shaft 28 results in approximately 3.8 rotations of the one countershaft 32 and 14.5 rotations of the energy-absorbing wheel 26. As described above, the back and forth oscillating cycle of the handlebar levers is the same as the rotational speed of the main drive shaft 28. Oscillation of the handlebar levers drives the wheel 26 through drive bars 122, the other countershaft 34, sprockets 128,96 and chain 130. This then drives the wheel 26 through the main drive shaft 28 as described above.

Three modes are available for driving the wheel 26. In a first mode it can be driven by the crank pedals 30 alone. In a second mode, it can be driven by the handlebar levers 36 alone. In a third mode, it can be driven by simultaneous operation of both pedal crank arms 30 and both handlebar levers 36.

Figure 3:
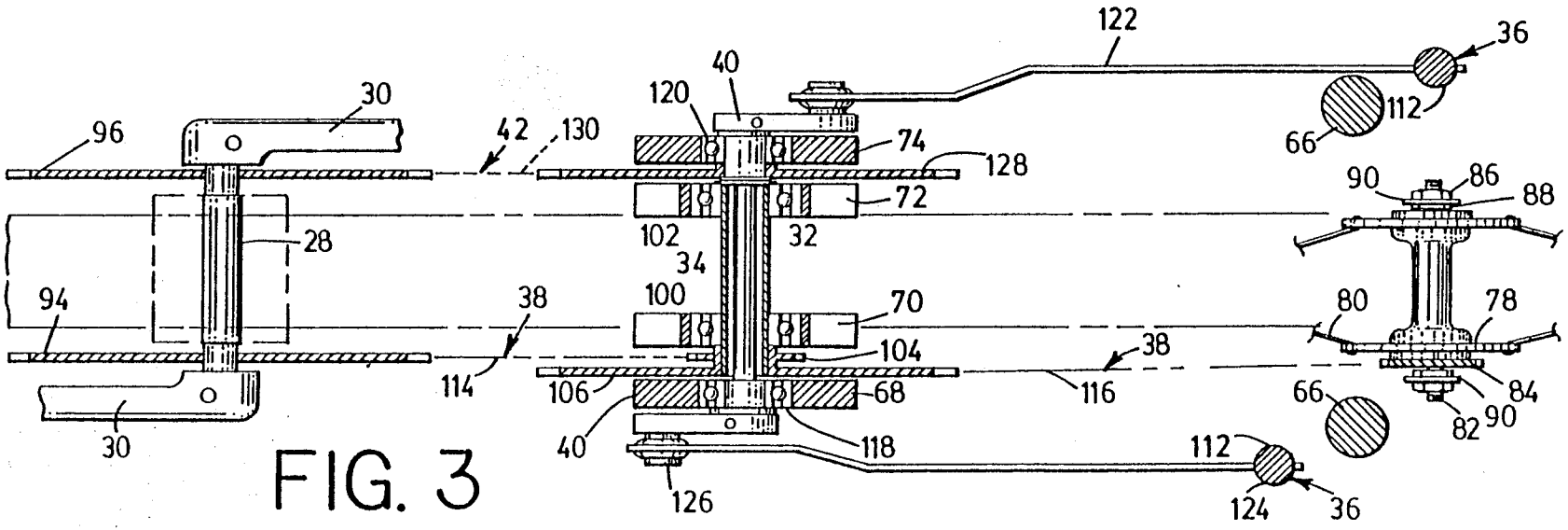
FIG. 3 is a view similar to FIG. 2 of another embodiment of the invention showing a different sprocket arrangement.
Figure 4:
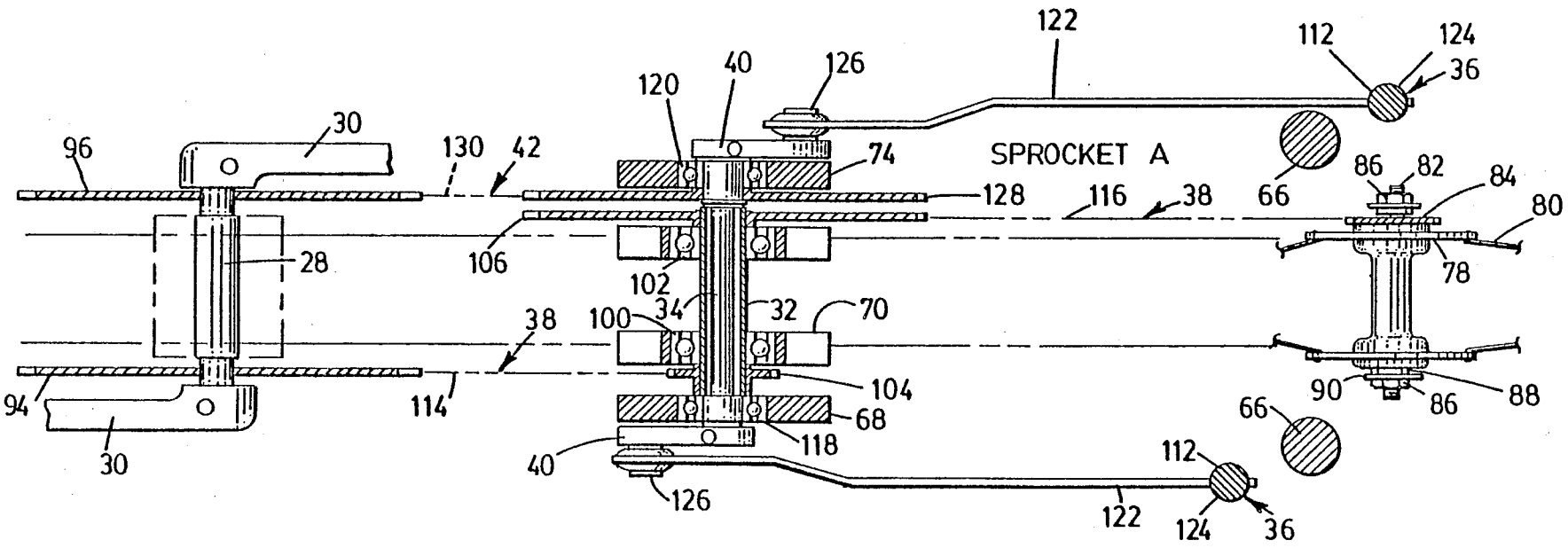
FIG. 4 is another embodiment of the invention showing a further, different sprocket arrangment.

These sprockets and chains may be arranged in different combinations on one side or the other of the frame. FIGS. 3 and 4 shown alternate arrangements. In FIG. 3, large sprockets 94,96 are on opposite sides of the frame, large sprockets 106,128 are on opposite sizes of the frame but reversed with respect to FIG. 2. And small sprockets 84,104 are both on the right side. In FIG. 4, large sprockets 94,96 are on opposite sizes, the same as shown in FIG. 3, but large sprockets 106,128 are on both the left side of the frame. And small sprockets 84,104 are on opposite sides.

Figure 5:
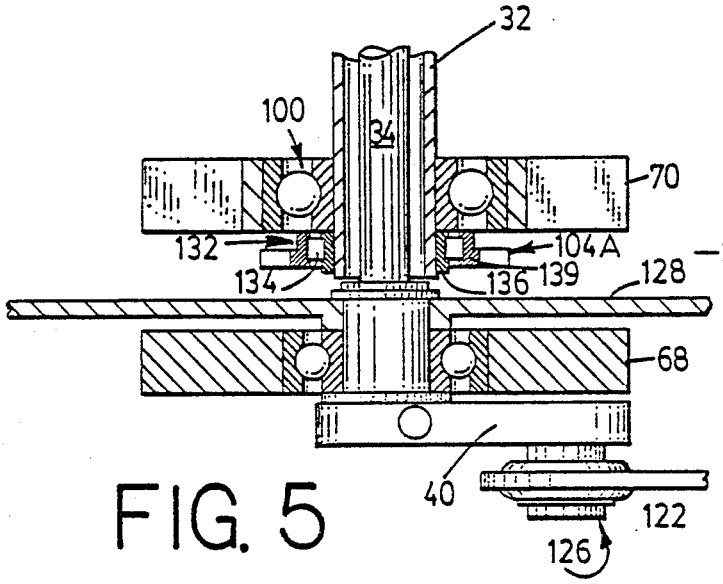
FIG. 5 is another embodiment showing a freewheel option comprising a unidirectional clutch on one of the countershafts.

In some instances, it may be beneficial to provide a freewheel arrangement enabling the pedals and handlebar levers to be stopped while the energy-absorbing wheel 26 continues to rotate under its own momentum. For this purpose, a one-way or overrunning clutch 132 with conventional non-circular sprags 134 between inner and outer races 136,138 may be incorporated into the small, driven sprocket 104. Such a modification is designated 104A in FIG. 5. This enables the one countershaft 32 and parts conencted to it to rotate with the wheel 26 under its momentum while the pedals and handlebar levers are slowed or stopped.

Figure 6:
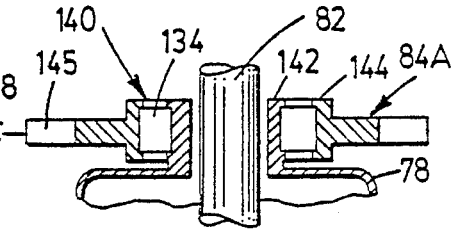
FIG. 6 is another embodiment showing a freewheel option comprising a unidirectional clutch on the axle of the energy-absorbing wheel.

As another example, FIG. 6 shows an alternative sprocket 84A incorporating a one-way or overrunning clutch 140. This includes an inner race 142 which is secured to or integral with the hub 78, an outer race 144 with teeth 145 engaging the chain 38, and intermediate sprags 134.

The embodiments described and shown to illustrate the present invention have been necessarily specific for purposes of illustration. Alterations, extensions, and modifications would be apparent to those skilled in the art. The aim of the appended claims, therefore, is to cover all variations included within the spirit and scope of the invention.

The embodiments of the invention in which an exclusive property or priviledge is claimed or defined as follows:

1. A cycle exerciser including:
a frame;
a seat mounted on said frame;
energy absorbing means rotatably mounted on said frame;
a substantially horizontal main drive shaft rotatably carried by said frame;
foot pedal crank arms at opposite ends of said main drive shaft;
a pair of coaxial countershafts rotatably carried by said frame;
two handlebar levers mounted on said frame for oscillating movement;
first drive means comprising means connecting said main drive shaft to said energy absorbing means through one of said countershafts to cause rotation of the energy absorbing means in response to rotation of said main drive shaft;
a pair of drive crank arms secured to opposite end portions of the other of said countershafts and extending laterally therefrom in opposite directions; and
second drive means including means connecting each of said handlebar levers to a respective one of said drive crank arms and means connecting said other countershaft to said main drive shaft to cause rotation of said main drive shaft in response to oscillating movement of said handlebar levers.

2. A cycle exerciser according to claim 1 in which one of said countershafts is a hollow tube and the other countershaft is concentrically rotatably journaled therewithin.

3. A cycle exerciser according to claim 1 in which said first drive means comprises separate orbitally moveable endless driving means trained between said main drive shaft and said one countershaft, and between said one countershaft and said energy absorbing means, respectively.

4. A cycle exerciser according to claim 3 in which at least one of said orbitally moveable endless driving means is chain and sprocket means.

5. A cycle exerciser according to claim 1 in which said means connecting said other countershaft to said main drive shaft causes them to rotate at the same speed.

6. A cycle exerciser according to claim 1 in which said second drive means includes a drive bar pivotally connected between each handlebar lever and a corresponding one of said drive crank arms, and a chain and sprocket connection between said other countershaft and said main drive shaft.

7. A cycle exerciser including:
a frame;
a seat mounted on said frame;
energy absorbing means rotatably mounted on said frame;
a substantially horizontal main drive shaft rotatably carried by said frame;
foot pedal crank arms at opposite ends of said main drive shaft;
a pair of countershafts rotatably mounted on said frame separate from said main drive shaft, one of said countershafts comprising a hollow tube and the other of said countershafts being disposed coaxially within said one countershaft;
two handlebar levers mounted on said frame for oscillating movement;
first drive means for causing rotation of said energy absorbing means comprising:
(a) a first sprocket on said main drive shaft and a second, smaller sprocket on one of said countershafts;
(b) a third sprocket on said one countershaft, and a fourth sprocket, smaller than the third sprocket, in driving relation with said energy absorbing means; and
(c) chain means interconnecting the first and third sprockets, and third and fourth sprockets, respectively;
second drive means for causing rotation of the main drive shaft in response to oscillating movement of the handlebar levers comprising:
(a) a pair of drive crank arms secured to opposite end portions of said other countershaft and extending laterally therefrom in opposite directions;
(b) a pair of drive bars pivotally connected between each handlebar lever and a corresponding one of said drive crank arms; and
(c) means interconnecting said other countershaft and said main drive shaft for rotation at the same speed.

8. A cycle exerciser according to claim 7 in which said means interconnecting said other countershaft and said main drive shaft for rotation at the same speed comprises a chain connecting fifth and sixth same-size sprockets mounted on the other countershaft and main drive shaft respectively.

9. A cycle exerciser according to claim 8 in which the first, second, fifth and sixth sprockets are on one side of the frame and the third and fourth sprockets are on the opposite side of the frame.

10. A cycle exerciser according to claim 8 in which the first, second, third and fourth sprockets are on one side of the frame and the fifth and sixth sprockets are on the opposite side of the frame.

11. A cycle exerciser according to claim 8 in which the first and second sprockets are on one side of the frame and the third, fourth, fifth and sixth sprockets are on the opposite side of the frame.

12. A cycle exerciser according to claim 8 in which the first, third, fifth and sixth sprockets are the same size.

13. A cycle exerciser according to claim 8 in which the second and fourth sprockets are the same size.

14. A cycle exerciser according to claim 7 in which a one-way clutch is provided in one of said second, third and fourth sprockets to enable pedal and handlebar lever movement to stop while the rotatable energy-absorbing means continues to rotate under its own momentum.

* * * * *

UNITED STATES PATENT AND TRADEMARK OFFICE

CERTIFICATE OF CORRECTION

PATENT NO. : 4,712,789

DATED : December 15, 1987

INVENTOR(S) : Frank P. Brilando

It is certified that error appears in the above-identified patent and that said Letters Patent is hereby corrected as shown below:

Column 6, line 41, "first and third" should read

-- first and second --.

Signed and Sealed this

Eleventh Day of October, 1988

*Attest:*

DONALD J. QUIGG

*Attesting Officer*

*Commissioner of Patents and Trademarks*